US011661307B2

(12) United States Patent
Sudi et al.

(10) Patent No.: US 11,661,307 B2
(45) Date of Patent: May 30, 2023

(54) CROWD SENSING FOR ELEVATOR SYSTEMS

(71) Applicant: Otis Elevator Company, Farmington, CT (US)

(72) Inventors: Sandeep Sudi, Farmington, CT (US); Bradley Armand Scoville, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 1094 days.

(21) Appl. No.: 16/371,369

(22) Filed: Apr. 1, 2019

(65) Prior Publication Data

US 2020/0307950 A1 Oct. 1, 2020

(51) Int. Cl.

| | |
|---|---|
| ***B66B 1/34*** | (2006.01) |
| ***B66B 1/24*** | (2006.01) |
| ***B66B 1/46*** | (2006.01) |
| ***B66B 3/00*** | (2006.01) |

(52) U.S. Cl.

CPC ..... *B66B 1/3407* (2013.01); *B66B 1/2408* (2013.01); *B66B 1/3476* (2013.01); *B66B 1/468* (2013.01); *B66B 3/00* (2013.01); *B66B 2201/211* (2013.01); *B66B 2201/215* (2013.01); *B66B 2201/222* (2013.01); *B66B 2201/234* (2013.01); *B66B 2201/243* (2013.01); *B66B 2201/402* (2013.01); *B66B 2201/403* (2013.01)

(58) Field of Classification Search

CPC ... B66B 1/3407; B66B 1/2408; B66B 1/3476; B66B 1/468; B66B 3/00; B66B 2201/211; B66B 2201/215; B66B 2201/222; B66B 2201/234; B66B 2201/243; B66B 2201/402; B66B 2201/403; B66B 1/2458; B66B 1/28; B66B 1/3423; B66B 1/3446; B66B 5/0012

See application file for complete search history.

(56) References Cited

U.S. PATENT DOCUMENTS

| | | | | |
|---|---|---|---|---|
| 5,022,497 | A | 6/1991 | Thanagavelu | |
| 5,241,142 | A * | 8/1993 | Thangavelu | B66B 1/2408 187/385 |
| 5,272,288 | A * | 12/1993 | Kameli | B66B 1/2408 187/387 |
| 11,232,312 | B2 * | 1/2022 | Chen | G06T 7/50 |
| 2014/0231177 | A1 | 8/2014 | Flynn et al. | |
| 2017/0190544 | A1 | 7/2017 | Witczak et al. | |
| 2017/0327344 | A1 | 11/2017 | Richmond et al. | |
| 2019/0016557 | A1 | 1/2019 | Baldi | |
| 2019/0308844 | A1 | 10/2019 | Kannan et al. | |

OTHER PUBLICATIONS

China Office Action for China Application No. 201911410478.0; Application Filing Date: Dec. 31, 2019; dated Jan. 27, 2022; 9 pages.

European Search Report for Europe Application No. 19219264.9; Application Filing Date: Dec. 23, 2019; dated Sep. 28, 2020, 10 pages.

* cited by examiner

*Primary Examiner* — Jeffrey Donels

(74) *Attorney, Agent, or Firm* — Cantor Colburn LLP

(57) ABSTRACT

An aspect includes capturing crowd data associated with a lobby area of an elevator system. A dispatching schedule of one or more elevator cars of the elevator system is adjusted based on the crowd data. A notification of the adjustment to the dispatching schedule is output.

19 Claims, 3 Drawing Sheets

CROWD SENSING FOR ELEVATOR SYSTEMS

BACKGROUND

The embodiments herein relate to elevator systems and, more particularly, to crowd sensing for elevator systems.

Elevators can vary in usage as occupancy levels at lobby areas change over time. Some advanced elevator systems enable passengers to remotely call for an elevator using an application on a mobile device. However, variability of crowd size can make it difficult to accurately predict an elevator car arrival time and may result in other passengers in the crowd taking an elevator car called by someone else. Further, crowds arriving at unexpected times can result in less efficient elevator car dispatching for systems that rely upon time-based priority scheduling of elevator cars.

SUMMARY

According to an embodiment, a method includes capturing crowd data associated with a lobby area of an elevator system. A dispatching schedule of one or more elevator cars of the elevator system is adjusted based on the crowd data. A notification of the adjustment to the dispatching schedule is output.

In addition to one or more of the features described herein, or as an alternative, further embodiments may include where the crowd data is captured by a sensing system.

In addition to one or more of the features described herein, or as an alternative, further embodiments may include where adjusting the dispatching schedule is selectively enabled on-demand in response to an enable command.

In addition to one or more of the features described herein, or as an alternative, further embodiments may include where adjusting the dispatching schedule is selectively enabled based on one or more of a predetermined schedule and an artificial intelligence algorithm configured to predict formation of a crowd.

In addition to one or more of the features described herein, or as an alternative, further embodiments may include where adjusting the dispatching schedule is selectively enabled based on verification of an active subscription to a crowd control service.

In addition to one or more of the features described herein, or as an alternative, further embodiments may include providing a priority request to schedule an empty elevator car targeting a selected user, and adjusting the dispatching schedule to incorporate the priority request.

In addition to one or more of the features described herein, or as an alternative, further embodiments may include where the notification of the adjustment to the dispatching schedule includes a message transmitted to one or more mobile devices associated with one or more targeted users.

In addition to one or more of the features described herein, or as an alternative, further embodiments may include determining a travel impact on a user based on the crowd data, and outputting a notification of a travel plan adjustment for the user based on the travel plan.

In addition to one or more of the features described herein, or as an alternative, further embodiments may include where the travel impact comprises an estimated delay for crowd reduction at the lobby area, and the notification of the travel plan adjustment includes a message indicating that a subsequent notification will be sent based on a crowd size reduction dropping below a predetermined threshold.

In addition to one or more of the features described herein, or as an alternative, further embodiments may include where the notification of the travel plan adjustment includes an identification of a priority elevator car dispatched for the user.

According to an embodiment, a system includes a sensing system configured to capture crowd data associated with a lobby area of an elevator system. The system also includes a dispatching system configured to adjust a dispatching schedule of one or more elevator cars of the elevator system based on the crowd data and output a notification of the adjustment to the dispatching schedule.

In addition to one or more of the features described herein, or as an alternative, further embodiments may include where adjustment of the dispatching schedule is selectively enabled on-demand in response to an enable command.

In addition to one or more of the features described herein, or as an alternative, further embodiments may include where adjustment of the dispatching schedule is selectively enabled based on one or more of a predetermined schedule and an artificial intelligence algorithm configured to predict formation of a crowd.

In addition to one or more of the features described herein, or as an alternative, further embodiments may include where adjustment of the dispatching schedule is selectively enabled based on verification of an active subscription to a crowd control service.

In addition to one or more of the features described herein, or as an alternative, further embodiments may include where the dispatching system is configured to provide a priority request to schedule an empty elevator car targeting a selected user and adjust the dispatching schedule to incorporate the priority request.

In addition to one or more of the features described herein, or as an alternative, further embodiments may include where the notification of the adjustment to the dispatching schedule includes a message transmitted to one or more mobile devices associated with one or more targeted users.

In addition to one or more of the features described herein, or as an alternative, further embodiments may include where the dispatching system is configured to determine a travel impact on a user based on the crowd data and output a notification of a travel plan adjustment for the user based on the travel plan.

In addition to one or more of the features described herein, or as an alternative, further embodiments may include where the travel impact comprises an estimated delay for crowd reduction at the lobby area, and the notification of the travel plan adjustment includes a message indicating that a subsequent notification will be sent based on a crowd size reduction dropping below a predetermined threshold.

In addition to one or more of the features described herein, or as an alternative, further embodiments may include where the notification of the travel plan adjustment includes an identification of a priority elevator car dispatched for the user.

According to an embodiment, a method includes capturing crowd data associated with a lobby area of an elevator system, determining a travel impact for a user based on the crowd data, and outputting a notification of a travel plan adjustment for the user based on the travel impact.

Technical effects of embodiments of the present disclosure include monitoring and adjusting elevator dispatch scheduling based on crowd data.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
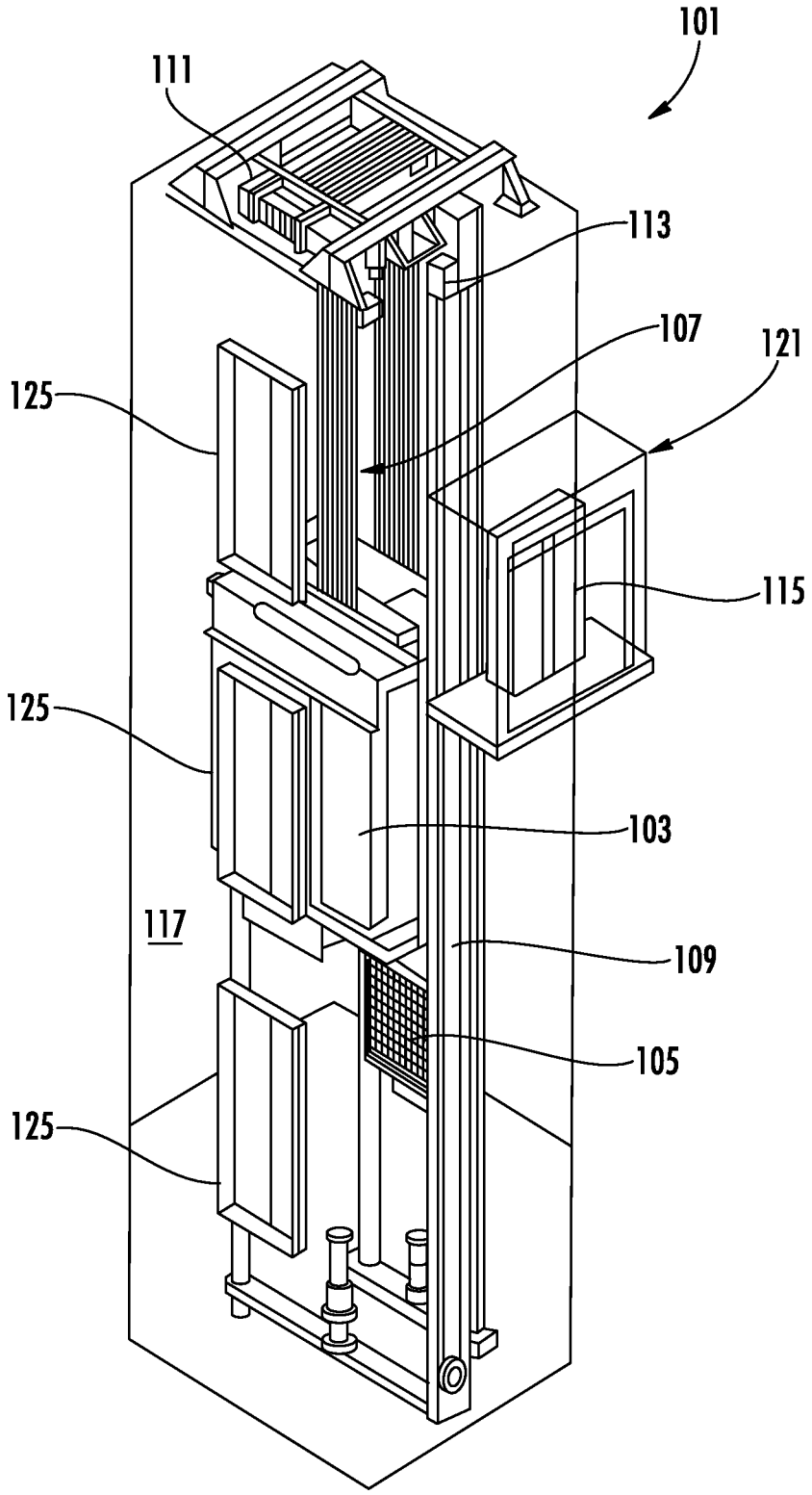
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator hoistway 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator hoistway 117, such as on a support or guide rail, and may be configured to provide position signals related to a position of the elevator car 103 within the elevator hoistway 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator hoistway 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator hoistway 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator hoistway 117.

Although shown and described with a roping system including tension member 107, elevator systems that employ other methods and mechanisms of moving an elevator car within an elevator hoistway may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

Figure 2:
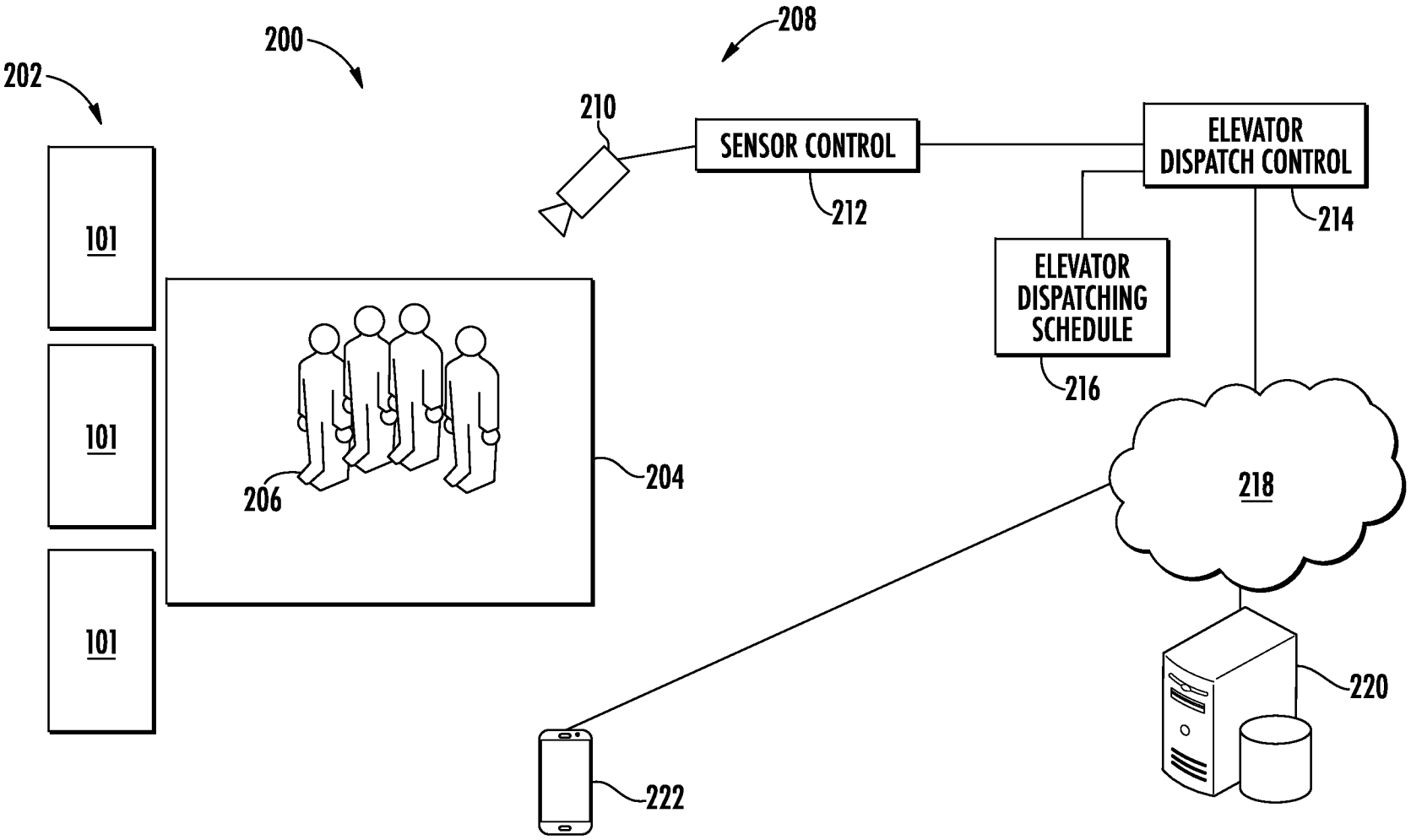
FIG. 2 depicts a system for managing elevator dispatching in an example embodiment.

Turning now to FIG. 2, an exemplary system 200 for managing elevator dispatching in accordance with one or more embodiments is shown. The system 200 may include one or more elevator systems 101 managed as an elevator group 202 accessible at multiple landings. Within a structure, such as a building, in which the elevator group 202 is installed, there can be one or more lobby areas 204 at one or more floors where crowds 206 may gather. For instance, lobby areas 204 may be on a ground floor or another level, such as a sky lobby or a floor with conference rooms, ball rooms, or other such areas where larger crowds may congregate. The system 200 includes a sensing system 208 configured to capture crowd data associated with a lobby area 204 of an elevator system 101. The sensing system 208 can include one or more sensors 210 and sensor control 212. In systems where multiple sensors are employed, the sensors 210 may be a common type of sensor or varied. Any type of sensor 210 suitable for moveable object detection may be employed. For example, sensors that rely on infrared, radar, video, LIDAR, time of flight, floor pressure sensors, and suitable alternatives, may be utilized. The sensors 210 may be positioned in various locations. For example, the sensors 210 may be located on the floor of a lobby area 204, or at elevated positions fixed to a structure in the lobby area 204. Sensor control 212 can be an edge computing node with image tracking, classification, and counting logic using one or more techniques known in the art to observe and track a number of people in the crowd 206 which may be quantified as crowd data. In some embodiments, the crowd data tracking 210 can include tracking an occupancy level in one or more lobby areas 204 and within elevator cars 103 of the elevator systems 101.

The system 200 can also include an elevator dispatch control 214 that is configured to receive the crowd data from the sensor control 212. The elevator dispatch control 214 can adjust a dispatching schedule 216 of one or more elevator cars 103 of the elevator group 202 of elevator systems 101 based on the crowd data. For example, the dispatching schedule 216 can be adjusted to position an increased number of elevator cars 103 in close proximity to floors of the lobby area 204 with increased crowds. Elevator dispatch control 214 can interface with controllers 115 of FIG. 1 as an example of elevator controllers. The elevator dispatch control 214 can also interface with a network 218, which can be part of a cloud computing environment configured to communicate with a plurality of devices. As one example, a server 220 can be connected to network 218 and implemented using known computing equipment (e.g., processor, memory, I/O devices, network communications, etc.). The server 220 may be implemented using the same equipment the elevator dispatch control 214 or may be a separate component. The network 218 may be a local network (e.g., 802.xx) or a wide range network (e.g., cellular) and may be implemented using known wired and/or wireless network protocols. The sensor control 212 and elevator dispatch control 214 can also be implemented using known processing circuitry, memory systems, communication interfaces and the like to execute instructions embodied in a non-transitory format.

The network 218 can also communicate with a plurality of user devices, such as mobile devices 222, that can be associated with the crowd 206 or a manager/supervisor system. Examples of mobile devices 222 can include a phone, a laptop, a tablet, smartwatch, etc. One or more of the mobile devices 222 may be associated with a particular user. The user may use his/her mobile device(s) 222 to request an elevator car 103 of FIG. 1. A request can be a call that allows an empty or partially filled elevator car 103 to be dispatched to a floor. The request can be manually initiated (e.g., on-demand) or initiated in response to sensor data. For automated requests based on sensor data, there can be a plurality of rules defined and/or predetermined schedules established. Rule-based systems can incorporate machine learning and artificial intelligence to dynamically define rules and further refine rules over a period of time. Artificial intelligence algorithms may be trained with a set of training data prior to deployment and further refined in the field to align with usage patterns of a particular building design and flow of traffic (e.g., passengers and/or cargo) for the elevator systems 101. Artificial intelligence algorithms can learn to predict timing, size, and locations of the crowd 206 and automatically set or modify dispatching profiles predictively before the crowd 206 arrives or fully forms, for instance, at lobby area 204.

The request for an elevator car 103 may be conveyed or transmitted from the mobile device 222 over one or more networks 218. For example, the request may be transmitted via the Internet and/or a cellular network. The request may then be routed through server 220 to the elevator dispatch control 214.

The elevator dispatch control 214 may select a resource (e.g., an elevator system 101 or elevator car 103) that is suited to fulfill a service request, potentially based on one or more considerations, such as power consumption/efficiency, quality of service (e.g., reduction in waiting time until a user or passenger arrives at a destination floor or landing), etc.

In embodiments, a system, such as the elevator dispatch control 214 or server 220, can use crowd data to alert passengers, use in-car space data to dispatch empty elevator cars 103 to users and communicate assignments to a management system. Elevator cars 103 with empty space can be identified and allocated through the dispatching schedule 216 to help users move themselves, luggage, companions, and the like to a desired location. In some embodiments, crowd data is used to determine when a lobby area 204 is sufficiently clear to notify a user to proceed to the lobby area 204. In other embodiments, where a user is in position to ride an elevator car 103 from the lobby area 204 to a desired area, the system 200 (e.g., elevator dispatch control 214 or server 220) can prioritize the user to send a premium elevator car 103 to a location of the user in the lobby area 204, e.g., an empty or substantially empty elevator car 103. People counting techniques can be used to measure wait times to improve the user experience.

Further, crowd sensing features can be a subscription-based service that an operator of the elevator systems 101, e.g., a building owner pays for to ensure an improved user experience. For example, crowd sensing can be selectively enabled for certain locations within a building, such as the lobby area 204. Further, timing of enablement of crowd sensing can change over time. For instance, if a large conference is scheduled, the elevator dispatching schedule 216 can be predictively adjusted based on schedule data. Further, on-demand crowd sensing can be selectively enabled for particular floors or any floors. Trending data can also be captured to better understand a history of user movement and crowds 206.

Figure 3:
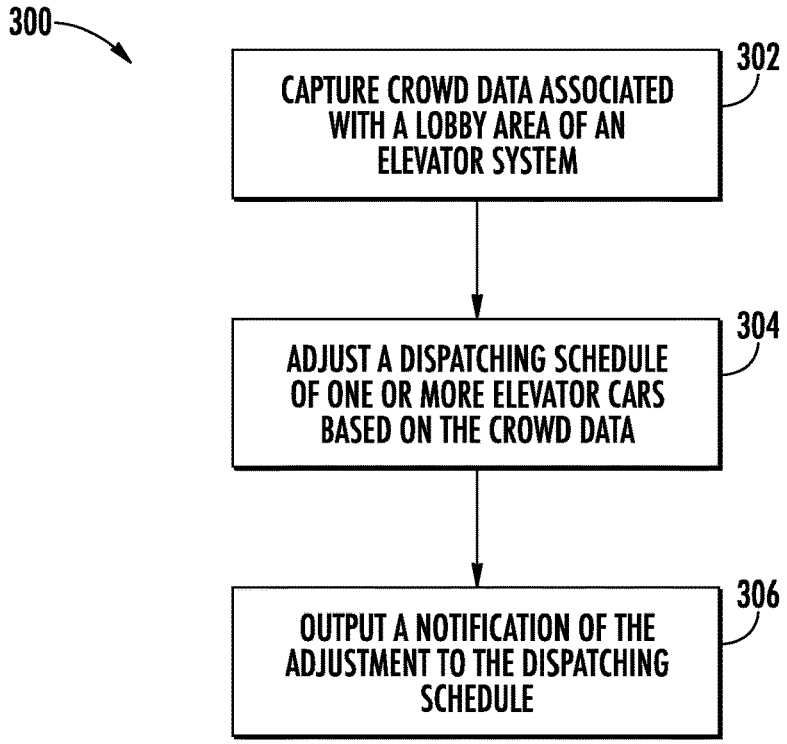
FIG. 3 depicts a method for managing elevator dispatching in an example embodiment.

FIG. 3 depicts a process 300 for managing elevator dispatching in an example embodiment and is described in reference to FIGS. 1-3. At block 302, crowd data associated with a lobby area 204 of an elevator system 101 is captured. The crowd data can be captured by a sensing system 208, such as a video camera, and image processing performed by the sensor control 212 or other device.

At block 304, a dispatching schedule 216 of one or more elevator cars 103 of the elevator system 101 can be adjusted, for instance, by the elevator dispatch control 214 based on the crowd data. Adjusting the dispatching schedule 216 can be selectively enabled on-demand in response to an enable command, for instance, through a graphical user interface. Adjusting the dispatching schedule 216 can be selectively enabled based on a predetermined schedule. Adjusting the dispatching schedule can be selectively enabled based on verification of an active subscription to a crowd control service. At block 306, the system 200 can output a notification of the adjustment to the dispatching schedule 216.

In embodiments, the system 200 can provide a priority request to schedule an empty elevator car 103 targeting a selected user, and the dispatching schedule 216 to incorporate the priority request can be adjusted. The notification of the adjustment to the dispatching schedule 216 can include a message transmitted to one or more mobile devices 222 associated with one or more targeted users, e.g., which can be part of crowd 206. In some embodiments, a travel impact on a user can be determined based on the crowd data. A notification of a travel plan adjustment for the user can be output based on the travel plan. The travel impact can include an estimated delay for crowd reduction at the lobby area 204. The notification of the travel plan adjustment can include a message indicating that a subsequent notification will be sent based on a crowd size reduction dropping below a predetermined threshold. The notification of the travel plan adjustment can include an identification of a priority elevator car 103 dispatched for the user.

Figure 4:
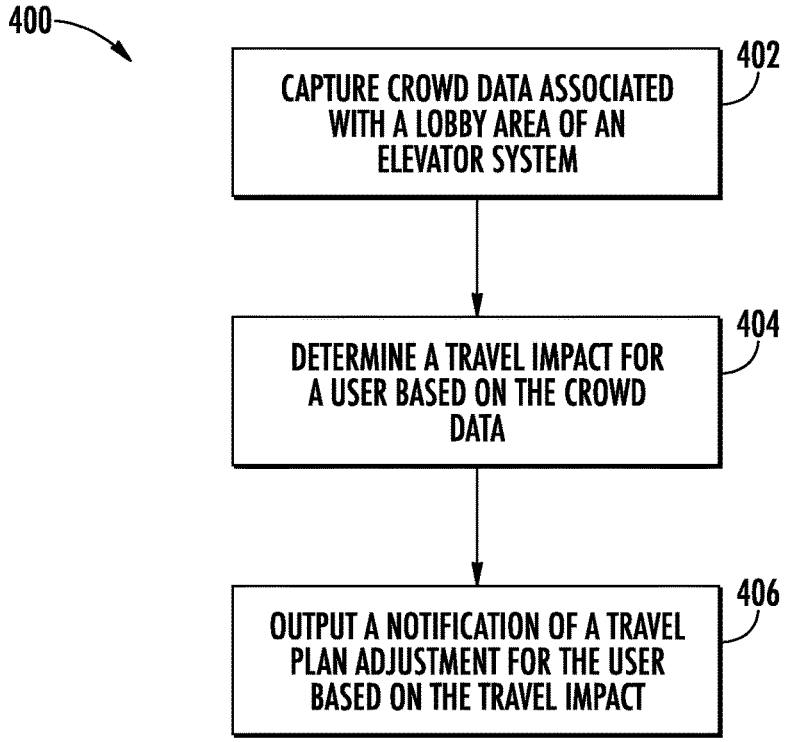
FIG. 4 depicts a method for user travel plan adjustment associated with an elevator system in an example embodiment.

FIG. 4 depicts a process 400 for user travel plan adjustment associated with an elevator system 101 in an example embodiment and is described in reference to FIGS. 1-4. At block 402, crowd data associated with a lobby area 204 of an elevator system 101 can be captured. At block 404, a travel impact for a user can be determined based on the crowd data. At block 406, a notification of a travel plan adjustment can be output for the user based on the travel impact.

As described above, embodiments can be in the form of processor-implemented processes and devices for practicing those processes, such as the elevator controller, access server and/or monitoring server. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A method comprising:

capturing crowd data associated with a lobby area of an elevator system;

providing a priority request to schedule an empty elevator car targeting a selected user;

adjusting a dispatching schedule of one or more elevator cars of the elevator system based on the crowd data, wherein adjusting the dispatching schedule incorporates the priority request; and outputting a notification of the adjustment to the dispatching schedule.

2. The method of claim 1 wherein the crowd data is captured by a sensing system.

3. The method of claim 1 wherein adjusting the dispatching schedule is selectively enabled on-demand in response to an enable command.

4. The method of claim 1 wherein adjusting the dispatching schedule is selectively enabled based on one or more of a predetermined schedule and an artificial intelligence algorithm configured to predict formation of a crowd.

5. The method of claim 1 wherein adjusting the dispatching schedule is selectively enabled based on verification of an active subscription to a crowd control service.

6. The method of claim 1 wherein the notification of the adjustment to the dispatching schedule comprises a message transmitted to one or more mobile devices associated with one or more targeted users.

7. The method of claim 1 further comprising:

determining a travel impact on a user based on the crowd data; and outputting a notification of a travel plan adjustment for the user based on the travel plan.

8. The method of claim 7 wherein the travel impact comprises an estimated delay for crowd reduction at the lobby area, and the notification of the travel plan adjustment comprises a message indicating that a subsequent notification will be sent based on a crowd size reduction dropping below a predetermined threshold.

9. The method of claim 7 wherein the notification of the travel plan adjustment comprises an identification of a priority elevator car dispatched for the user.

10. A system comprising:

a sensing system configured to capture crowd data associated with a lobby area of an elevator system; and a dispatching system configured to provide a priority request to schedule an empty elevator car targeting a selected user, adjust a dispatching schedule of one or more elevator cars of the elevator system based on the crowd data and output a notification of the adjustment to the dispatching schedule, wherein adjustment of the dispatching schedule incorporates the priority request.

11. The system of claim 10 wherein adjustment of the dispatching schedule is selectively enabled on-demand in response to an enable command.

12. The system of claim 10 wherein adjustment of the dispatching schedule is selectively enabled based on one or more of a predetermined schedule and an artificial intelligence algorithm configured to predict formation of a crowd.

13. The system of claim 10 wherein adjustment of the dispatching schedule is selectively enabled based on verification of an active subscription to a crowd control service.

14. The system of claim 10 wherein the notification of the adjustment to the dispatching schedule comprises a message transmitted to one or more mobile devices associated with one or more targeted users.

15. The system of claim 10 wherein the dispatching system is configured to determine a travel impact on a user based on the crowd data and output a notification of a travel plan adjustment for the user based on the travel plan.

16. The system of claim 15 wherein the travel impact comprises an estimated delay for crowd reduction at the lobby area, and the notification of the travel plan adjustment comprises a message indicating that a subsequent notification will be sent based on a crowd size reduction dropping below a predetermined threshold.

17. The system of claim 15 wherein the notification of the travel plan adjustment comprises an identification of a priority elevator car dispatched for the user.

18. A method comprising:

capturing crowd data associated with a lobby area of an elevator system;

adjusting a dispatching schedule of one or more elevator cars of the elevator system based on the crowd data, wherein adjusting the dispatching schedule is selectively enabled based on verification of an active subscription to a crowd control service; and outputting a notification of the adjustment to the dispatching schedule.

19. A method comprising:

capturing crowd data associated with a lobby area of an elevator system;

adjusting a dispatching schedule of one or more elevator cars of the elevator system based on the crowd data;

outputting a notification of the adjustment to the dispatching schedule;

determining a travel impact on a user based on the crowd data, wherein the travel impact comprises an estimated delay for crowd reduction at the lobby area; and outputting a notification of a travel plan adjustment for the user based on the travel plan, wherein the notification of the travel plan adjustment comprises a message indicating that a subsequent notification will be sent based on a crowd size reduction dropping below a predetermined threshold.

* * * * *